United States Patent [19]

Kircher

[11] 3,975,255

[45] Aug. 17, 1976

[54] INTER-ELECTRODE SPACING IN DIAPHRAGM CELLS

[75] Inventor: Morton S. Kircher, Oakville, Canada

[73] Assignee: Olin Corporation, New Haven, Conn.

[22] Filed: Feb. 27, 1974

[21] Appl. No.: 446,186

[52] U.S. Cl. ..... 204/252; 204/266; 204/279; 204/286

[51] Int. Cl.[2] ..... C25B 1/26; C25B 9/00; C25B 9/02; C25B 13/00

[58] Field of Search ..... 204/252, 266, 253, 279, 204/280, 286

[56] References Cited

UNITED STATES PATENTS

| | | | |
|---|---|---|---|
| 3,477,938 | 11/1969 | Kircher | 204/266 |
| 3,583,898 | 6/1971 | Giacopelli | 204/266 X |
| 3,755,108 | 8/1973 | Raetzsch et al. | 204/256 X |
| 3,796,648 | 3/1974 | Conner, Jr. et al. | 204/252 X |

*Primary Examiner*—Howard S. Williams
*Assistant Examiner*—A. C. Prescott
*Attorney, Agent, or Firm*—James B. Haglind; Donald F. Clements; Thomas P. O'Day

[57] ABSTRACT

Inter-electrode spacing in an electrolytic diaphragm cell is controlled by the attachment of a spacer to the anode edge which is closest to the cathode wall. In addition to providing the proper inter-electrode spacing the spacer serves as a guide for the anode during the positioning of an anode between adjacent diaphragm covered cathodes while assembling in cell. This minimizes damage to the diaphragm during assembly.

8 Claims, 4 Drawing Figures

INTER-ELECTRODE SPACING IN DIAPHRAGM CELLS

This invention relates to electrolytic diaphragm cells for the electrolysis of aqueous salt solutions. More particularly this invention relates to inter-electrode spacing in electrolytic diaphragm cells for the electrolysis of aqueous salt solutions.

In electrolytic diaphragm cells, the control of the inter-electrode distance between the anode and the cathode is economically important. This is particularly true for diaphragm cells where the anodes and cathodes are attached to and supported by two opposing walls of the cell. The anode-cathode spacing should be selected to maintain the cell voltage as close as possible to the decomposition voltage of the system being electrolyzed.

Careful control of the anode-cathode spacing means the reduction of wasteful consumption of energy, for example in the production of heat, and the avoidance of short circuiting and its accompanying problems, for example, destruction of anode surface and the contamination of the electrolytic products, among others.

It is also important to provide means for guiding the electrodes while the cell is being assembled to avoid damage to the anode surface or the diaphragm. Where metal anodes are used, for example, those having a platinum metal coating on a valve metal base, care should be taken to avoid removing the coating when the anodes are inserted between the cathodes. Likewise, gouging or scraping of the diaphragm by the anode should be avoided.

Various techniques have been tried to position the electrodes and provide the desired inter-electrode spacing. For example, U.S. Pat. No. 3,247,090 describes the use of metal plates attached to the cathode. Spacer blocks are positioned on the anode wall in U.S. Pat. No. 3,477,938. Plastic lines or cords are wrapped about the cathode plates as spacers and used in conjunction with separate guides attached to the cathode in U.S. Pat. No. 3,732,153.

None of the above methods, however, provide a single means of guiding the electrodes dueing the assembly of the cell and providing the desired inter-electrode spacing once the cell has been assembled.

It is an object of the present invention to provide a diaphragm cell which can be readily assembled without damage to electrodes or diaphragms.

Another object of the invention is to provide a diaphragm cell having the desired inter-electrode spacing upon assembly.

A further object of the invention is to provide a method for positioning an anode in a diaphragm cell.

These and other objects of the invention are accomplished in a diaphragm cell for electrolyzing an electrolyte comprised of at least one anode attached to an anode wall, at least one cathode attached to a cathode wall and a diaphragm attached to the cathode. The anode is positioned adjacent to and apart from the cathode. A spacer is attached to the leading edge of the anode and covers a portion of the anode sides to space the anode apart from the cathode a predetermined distance.

Accompanying FIGS. 1–4 illustrate the present invention. Corresponding parts have the same numbers in all Figures.

Apparatus described in FIGS. 1–4 when used to electrolyze aqueous solutions of alkali metal halides forms halogen gas, hydrogen gas and an alkali metal hydroxide liquor. However, those skilled in the art will recognize that modifications can be made for the use of other starting materials to produce other products.

Figure 1:
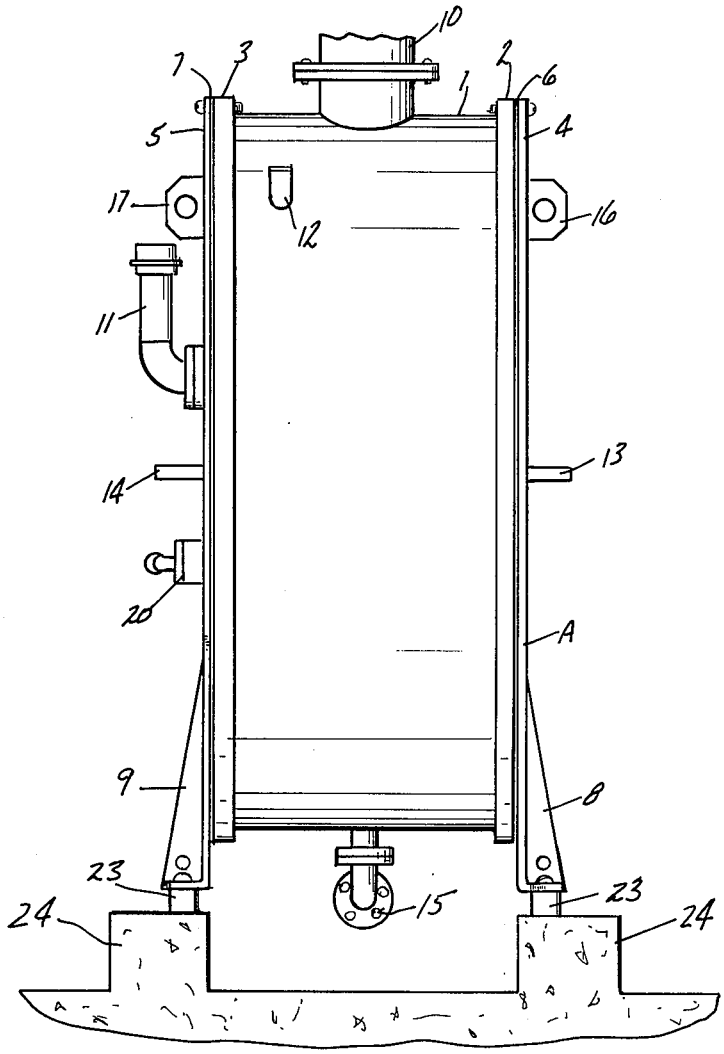
FIG. 1 illustrates a side view of one embodiment of a diaphragm cell suitable for use with the present invention.

More in detail, FIG. 1 is a side view illustrating diaphragm cell A having horizontal generally cylindrical cell body 1 and having flanges 2 and 3 surrounding each opening at the ends of cell body 1. Anode wall 4 is attached to flange 2 at one end of cell body 1 and cathode wall 5 is attached to flange 3 at the other end of cell body 1. Gaskets 6 and 7 seal anode wall 4 to flange 2 and cathode wall 5 to flange 3, respectively.

An aqueous alkali metal halide solution to be electrolzed enters thru brine inlet 12 housed in cell body 1. Halogen gas is removed through halogen outlet 10, and hydrogen gas is removed through outlet 11. Electric current is introduced to the cell through conductor 13 attached to anode wall 4. Current is removed from the cell at conductor 14 attached to cathode wall 5.

Cathode wall 5 and anode wall 4 support the weight of cell body 1. Anode wall supports 8 bear the weight of anode wall 4 and cathode wall supports 9 uphold cathode wall 5. Anode wall supports 8 and cathode wall supports 9 are bolted or otherwise attached to insulators 23 resting on platforms 24.

Drain 15 permits the contents of the cell to be removed. Lugs 16 and 17 aid in the removal of conductive anode wall 4 and conductive cathode wall 5, respectively.

Figure 2:
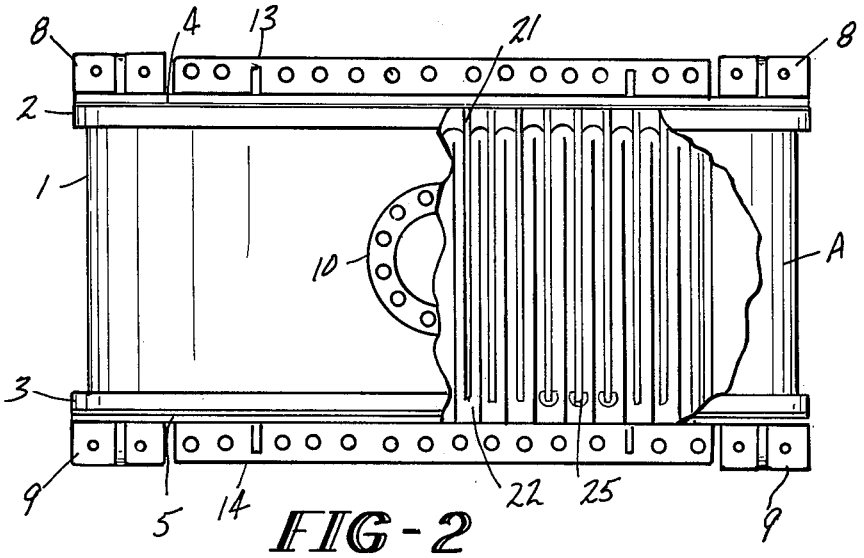
FIG. 2 shows a partially sectioned top view of the diaphragm cell of FIG. 1.

FIG. 2 depicts a partially sectioned top view of diaphragm cell A of the present invention. Anodes 21 are attached to anode wall 4 and project across the cell toward cathode wall 5. Cathodes 22 are attached to cathode wall 5 and project across the cell towards anode wall 4. Cathodes 22 support a diaphragm (not shown) of the type described more fully below. Anodes 21 are inserted within the spaces between adjacent cathodes 22. Spacers 25, attached to anodes 21, space apart anodes 21 from the cathodes 22. Current enters the cell thru conductor 13 and flows thru anode wall 4, thru anodes 21 attached, thru the electrolyte between anodes 21 and cathodes 22 and thru cathods 22 to cathode wall 5. Thus, the current passes thru the cell in a short and direct path. Conductors 13 and 14 have a series of holes permitting these conductors to be attached to conductors on adjacent cells, for example, with bolts.

Figure 3:
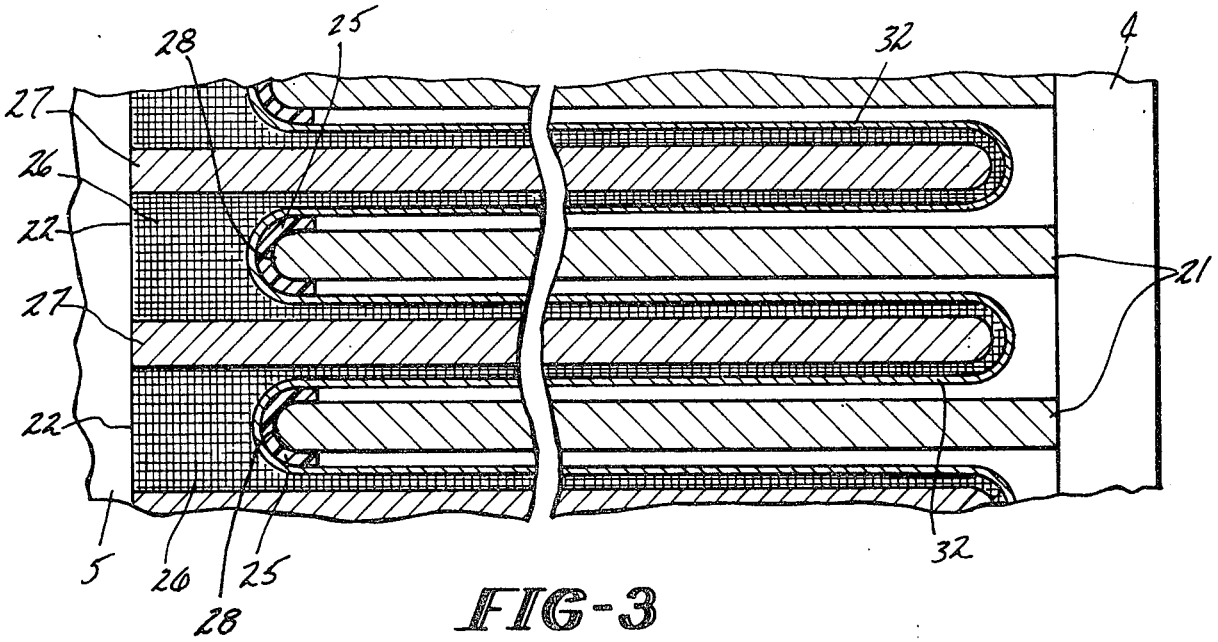
FIG. 3 depicts an enlarged view of a portion of the anode-cathode section of FIG. 2 showing the placement of the spacers of the present invention.

An enlarged view of the exposed section of FIG. 2 is shown in FIG. 3. Anodes 21, attached to anode wall 4, are inserted between adjacent cathodes 22 attached to cathode wall 5. Cathodes 22 are comprised of screens 26 attached to conductors 27. Diaphragms 32 are attached to screens 26. Spacers 25 are attached to leading edge 28 of anode 21. Spacers 25 space apart anodes 21 from diaphragms 32 attached to the sides of cathodes 22.

Figure 4:
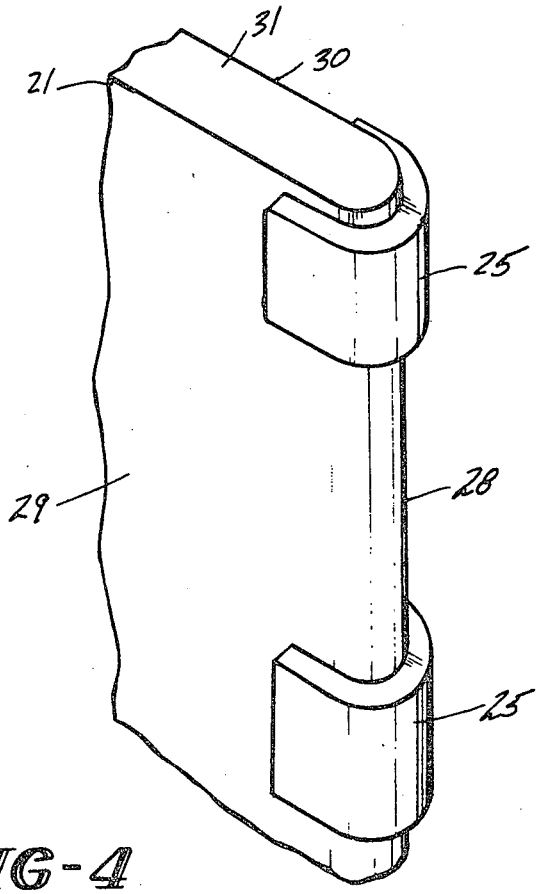
FIG. 4 is an enlarged view of a portion of an anode having the spacers of the present invention attached.

FIG. 4 shows an enlarged view of a section of anode 21 having sides 29 and 30, leading edge 28 and upper edge 31. Spacers 25 are attached to leading edge 28 and a portion of sides 29 and 30.

The spacers may be composed of non-conductive materials which are resistant to the electrolytes and products of electrolysis formed. The material should have a degree of flexibility but remain semi-rigid at the operating temperatures of the cell. Suitable materials include hard rubber and plastic materials such as polytetrafluoroethylene, polyvinylidene chloride, polyester resins, polyvinyl chloride and post-chlorinated polyvinyl chloride.

The spacers are fixedly attached to the leading edge of the anode so as to remain in position while the cell is in operation. The leading edge is the edge of the anode which, upon assembly, is nearest to the cathode wall. In this way, the spacer serves as a guide for the anode during its insertion between a pair of adjacent cathodes and also provides the desired inter-electrode spacing once the electrode units have been assembled. As a guide, the spacer protects the anode from damage by scraping or rubbing. This is particularly important where the anodes are the valve metal type having an outer coating of a precious metal such as platinum. In addition, the spacer prevents serious damage to the diaphragm attached to the outside of the cathodes by preventing the edges of the anodes from gauging or scraping off the diaphragm.

The spacer may occupy any desired portion of the leading edge of the anode. For example, it may cover the entire edge of the anode or any suitable portion thereof. If desired, a plurality of spacers of a predetermined length may be attached to the leading edge of the anode. For example from about two to about 10, and preferably from about two to about six spacers having a length of from about 1 to about 20 inches, and preferably from about 1.5 to about 6 inches may be employed. Each spacer is separated by a predetermined distance to provide the desired inter-electrode spacing while permitting maximum flow of current from the anode edge for electrolysis. Preferably the spacers are spaced equidistant from the ends of the anode and equidistant from each other. In addition to covering a portion of the leading edge, the spacers cover a portion of both sides of the anode. This portion should be sufficient to provide the desired inter-electrode spacing while permitting maximum use of the anode surface for electrolysis. In addition to attaching the spacers to the anode edge closest to the cathode wall upon assembly of the diaphragm cell, spacers may be located along the other edges of the anode, if desired.

The spacer may be of any desired thickness, with the thickness of the spacer along the leading edge being the same or different from the thickness of the spacer along the anode sides. The thickness of the spacer along the anode sides is selected to give the desired inter-electrode distance between the anode and adjacent cathodes. This distance is, for example, from about 1/32 to about ½ inches, and preferably from about 1/16 to about ⅜ inches.

It will be readily understood that while the thickness of spacers on adjacent anodes will usually be the same, if desired, spacers of varying thicknesses may be employed.

While any convenient shape may be used, the spacer is generally C- or U-shaped. In one embodiment, the spacer is formed from a section of plastic tubing by cutting a section of the tubing away. This provides a spacer which when attached to the leading edge, is self-adhering. Any convenient method of attachment, may be used to secure the spacer to the leading edge and the anode sides, for example, by employing suitable adhesives.

Anodes suitable for use with this invention may be composed of graphite. Preferably, however, a metal anode is used, for example, composed of a valve metal such as titanium or tantalum, or a metal, for example, steel, copper or aluminum clad with a valve metal such as titanium or tantalum. The valve metal has a thin coating over at least part of its surface of a platinum group metal, platinum group metal oxide, an alloy of a platinum group metal, or a mixture thereof. The term "platinum group metal" as used in the specification means an element of the group consisting of ruthenium, rhodium, palladium, osmium, iridium and platinum.

Anodes can be made in various forms, for example, solid sheets, perforated plates and in the case of conductive metal, as expanded metal or screen. The anodes are attached to the anode support plate by bolting, welding, soldering, or the like.

The anodes employed may be any convenient size, for example, from about 1 to about 12, and preferably from about 2 to about 10 feet in height; from about 1 to about 6, and preferably, from about 2 to about 5 feet in length; and from about 0.05 to about 1.00, and preferably from about 0.1 to about 0.8 inches thick.

A plurality of anodes are attached to the anode wall, the exact number depending on the size of the anode wall. In a diaphragm cell employing the present invention, for example, from about two to about 100 or more, and preferably from about five to about 50 anodes are attached to the anode wall and constitute the anode section. The anodes are positioned parallel to and separated from each other on the anode wall.

A plurality of cathodes are attached to the cathode wall, the exact number depending on the size of the cathode wall. In a diaphragm cell employing the present invention, for example, from about two to about 100 or more and preferably from about five to about 50 cathodes constitute the cathode section. The cathodes are positioned parallel to and separated from each other on the cathode wall.

The cathodes are foraminous projections extending across the cell body. A single cathode comprises a conductive element surrounded by a conductive screen or mesh. The conductive element may be, for example, in the form of a plate or rod with attachment means for the screen or mesh.

The cathodes may be of any convenient size, for example, from about 1 to about 12, and preferably from about 2 to about 10 feet in height; from about 1 to about 6 and preferably from about 2 to about 5 feet in length; and from about 0.5 to about 2.0 and preferably from about 0.8 to about 1.5 inches thick. Cathodes are attached to the cathode wall by any suitable means, for example, by welding or bolting.

The anode wall and cathode wall are composed wholly or partly of an electroconductive material, for example, steel or copper or combinations of these materials. To avoid corrosive damage to the anode and cathode wall, they may be covered, for example, with hard rubber, a plastic such as polytetrafluoroethylene or fiber reinforced plastic.

Any conventional inert diaphragm material can be applied or deposited on the cathodes. The diaphragm material used to cover the screen or foraminous portion of the cathode is a fluid-permeable and halogen-resistant material. Preferably the material is asbestos fiber deposited on the outer surfaces of the cathode screen by the application of suction to an asbestos fiber slurry. Other diaphragm materials such as polyvinylidene chloride, polypropylene, or polytetrafluoroethylene may also be used. The cathode struture is adapted to permit the use of all types of diaphragms including sheet asbestos, deposited asbestos and synthetics which can be in the form of woven fabrics, for example, polyethylene, polypropylene or polytetrafluoroethylene.

The inter-electrode spacers of the present invention may suitably be used with anodes employed in diaphragm cells of any suitable design. Illustrative types of diaphragm cells include those of U.S. Pat. Nos. 1,862,244; 2,370,087, 2,987,463; 3,461,057; 3,617,461 and 3,642,604. Particularly suitable are diaphragm cells in which the anodes and cathodes are mounted on opposite side walls of the cell, for example, in U.S. Pat. Nos. 3,247,090 or 3,477,938.

What is claimed is:

1. A diaphragm cell for electrolyzing an electrolyte comprised of;

1. a horizontal container having opposite and substantially parallel ends, said container having a first opening at one end and a second opening at the opposite end;
2. a cathode wall removably secured to said container and covering said first opening;
3. an anode wall removably secured to said container and covering said second opening;
4. a plurality of cathodes attached to said cathode wall, said cathodes being positioned parallel to and separated from each other and projecting across said cell towards said anode wall;
5. a diaphragm attached to said cathodes;
6. a plurality of anodes attached to said anode wall, said anodes being positioned parallel to and separated from each other and projecting across said cell towards said cathode wall wherein the edge of each anode closest to the cathode wall is defined as the leading edge, said anodes being positioned adjacent to and apart from said cathodes;
7. at least one non-conductive spacer fixedly attaced to the leading edge and a portion of each side of each of said anodes so as to remain in position to space said anodes apart from said cathodes a predetermined distance while cell is in operation, wherein said leading edge is the edge closest to said cathode wall.

2. The diaphragm cell of claim 1 in which said at least one non-conductive spacer is a plastic material selected from the group consisting of polytetrafluoroethylene, polyvinylidene chloride and polyvinyl chloride.

3. The diaphragm cell of claim 2 in which said plastic material is polytetrafluoroethylene.

4. The diaphragm cell of claim 1 in which said anode is spaced apart from said cathode by a distance of from about 1/32 to about ½ inches.

5. The diaphragm cell of claim 4 in which a plurality of spacers of from about two to about 10 are attached to said anode.

6. The diaphragm cell of claim 5 in which the length of said spacers is from about 1 to about 20 inches.

7. The diaphragm cell of claim 1 in which said at least one non-conductive spacer is C- or U-shaped.

8. A method of assembling a diaphragm cell having a horizontal container, said container having opposite and substantially parallel ends, said container having a first opening at one end and a second opening at the opposite end; a cathode wall removably secured to said container and covering said first opening; and anode wall removably secured to said container and covering said second opening, said method which comprises:

1. attaching a plurality of anodes to said anode wall, said anodes being positioned parallel to and separated from each other and projecting across said cell towards said cathode wall;
2. attaching a plurality of cathodes to said cathode wall, said cathodes being positioned parallel to and separated from each other and projecting across the cell towards said anode wall;
3. attaching a diaphragm to said cathodes;
4. attaching at least one non-conductive spacer to the leading edge and a portion of each side of each of said anodes, wherein said leading edge is the edge closest to said cathode wall, and;
5. positioning said anodes having said non-conductive spacer attached adjacent to said cathodes, said spacer remaining in position where it provides the desired spacing between said anodes and said cathodes once the cell has been assembled.

* * * * *